US005540594A

United States Patent [19]

Collins et al.

[11] Patent Number: 5,540,594

[45] Date of Patent: Jul. 30, 1996

[54] ELASTOMERIC CONNECTOR HAVING INCREASED COMPRESSION RANGE

[75] Inventors: Donnie B. Collins, King; Warren A. Bates, Winston-Salem, both of N.C.

[73] Assignee: The Whitaker Corporation, Wilmington, Del.

[21] Appl. No.: 267,989

[22] Filed: Jun. 29, 1994

[51] Int. Cl.[6] ..... H01R 9/09

[52] U.S. Cl. ..... 439/66; 439/91; 439/591

[58] Field of Search ..... 439/66, 91, 591, 439/197

[56] References Cited

U.S. PATENT DOCUMENTS

| | | | |
|---|---|---|---|
| 3,795,884 | 3/1974 | Kotaka | 439/591 |
| 3,851,297 | 11/1974 | Monro | 439/591 |
| 3,951,493 | 4/1976 | Kozel et al. | 439/591 |
| 3,985,413 | 10/1976 | Evans . | |
| 4,220,389 | 9/1980 | Schell | 439/197 |
| 5,002,496 | 3/1991 | Fox, Jr. | 439/197 |
| 5,102,343 | 4/1992 | Knight et al. | 439/197 |
| 5,199,882 | 4/1993 | Bates et al. | 439/66 |

*Primary Examiner*—P. Austin Bradley
*Assistant Examiner*—Jill DeMello

[57] ABSTRACT

This invention is directed to an improved elastomeric connector. The connector typically includes an elongated elastomeric core, having a substantially uniform cross section throughout its length, and a flexible film having electrical circuitry thereon for electrically interconnecting a pair of members having complementary electrical circuitry on its surface. The flexible film is wrapped about and supported by the elastomeric core to form the connector. In use the connector may be subjected to a compressive force to effect the electrical interconnection. The improved feature hereof is the provision of the wrapped and supported film defining a predetermined planar area, and that the area of the elastomeric core within the planar area is no more than about 90% of the planar area. The elastomeric core may assume a variety of regular or irregular cross sections under the guidelines of this invention, provided, however, there is sufficient peripheral support to the overlying flexible film at the location(s) for electrically interconnecting to the planar electronic devices.

6 Claims, 3 Drawing Sheets

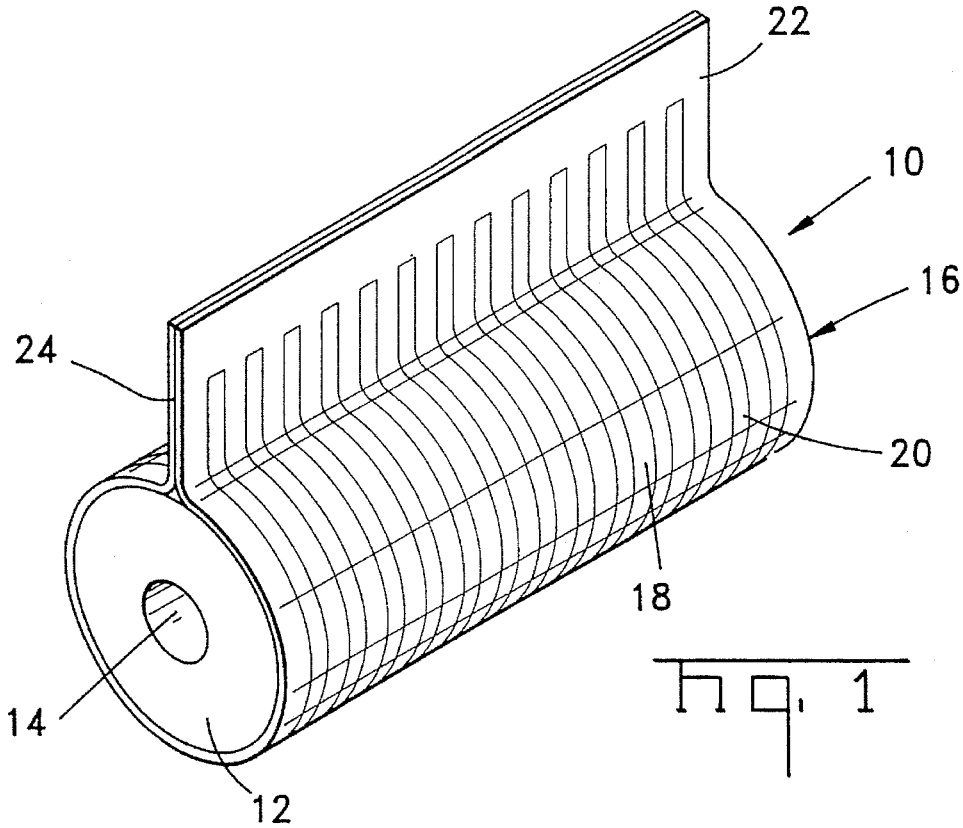
Fig. 1
Fig. 2
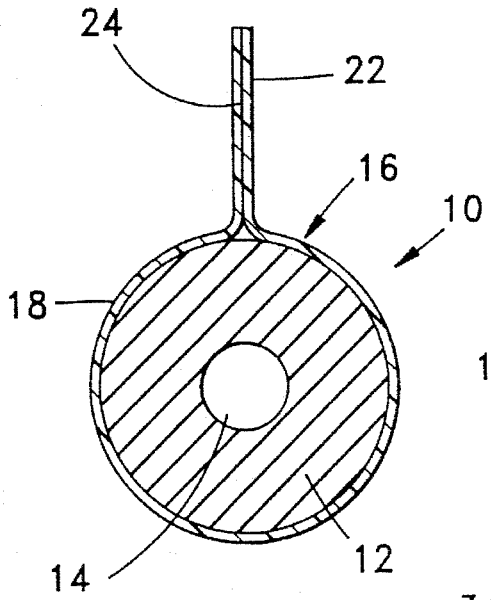
Fig. 3
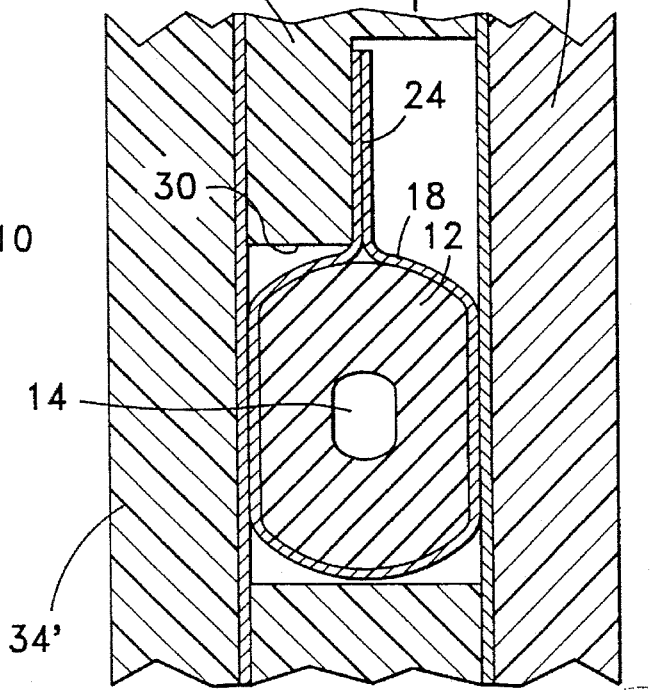

ELASTOMERIC CONNECTOR HAVING INCREASED COMPRESSION RANGE

BACKGROUND OF THE INVENTION

This invention is directed to the field of developments known as elastomeric electrical connectors, where such connectors were introduced in the 1970's, as evidenced by U.S. Pat. No. 3,985,413, to Evans and owned by the assignee hereof. A commercial product, embodying the principles of Evans, is marketed under the name AMPLIFLEX, a trademark owned by The Whitaker Corporation, Wilmington, Del., and licensed to AMP Incorporated, Harrisburg, Pa.

Elastomeric connectors are made of conductive surface patterns supported by insulating silicone rubber. Electrical contact is made by positioning the elastomeric element between substrates and applying a low contact pressure to generate the required normal force. More precisely, the AMPLIFLEX connector utilizes a thin flexible polyamide film—on which are individual parallel lines of ½ or 1.0 oz. etched copper circuitry plated with gold over nickel—wrapped around a soft, non-conducting silicone core. The core is formulated to resist permanent set under long term compression.

As illustrated in the patent to Evans, the film is wrapped around the elastomeric core where the end portions are joined together. The end portions of the film are against each other and extend radially with respect to the body to form a tab. The opposed surfaces of these end portions are bonded to each other by a bonding material which is fused to the surfaces and the end portions. It will be appreciated that the conductors are of a uniform length and have their ends in alignment. These ends do not extend to the side edges of the film so that there is a bend of film adjacent to the free end of the tab which is devoid of conductors.

One of the shortcomings of the elastomeric connectors available commercially is that they exhibit a limited compression range. Typically such connectors are placed between a pair of parallel walls where the free or open ends are compressed between a pair of planar electronic devices, such as printed circuit boards. It will be understood that the elastomeric connector is thusly squeezed from four sides into the confined space between said parallel walls. By the use of a solid core, as taught by Evans, the core must be deflected since the silicone elastomeric material is hydraulic in nature. This results in a very high force at very early stages of deflection of the planar electronic devices. If the cavity or space containing the connector is filled, a significant amount of force results for a small additional deflection. This additional force can impact on the planar electronic devices causing them to bow or warp.

The present invention, by the inclusion of a space or hole about or within the core, allows the core to be deflected inward, into the space or hole, giving it a greater range of deflection retiring a lower necessary force.

The advantages of this invention will become apparent from the specification which follows, particularly when read in conjunction with the accompanying drawings.

SUMMARY OF THE INVENTION

This invention is directed to an elastomeric electrical connector of the type including an elongated elastomeric core, having a substantially uniform cross section throughout its length, and a flexible film having electrical circuitry thereon for electrically interconnecting a pair of members having complementary electrical circuitry thereon. The flexible film is wrapped about and supported by the elastomeric core to form the connector. In use, the connector may be subjected to a compressive force to effect the electrical interconnection. The improved feature of this invention is the provision of the wrapped and supported film defining a predetermined planar area, and that the area of the elastomeric core within the planar area is no more than about 90% of said planar area. This reduction in sectional area may be achieved by the use of an axial hole, or by the use of one or more longitudinal grooves or slots along the periphery of the core.

BRIEF DESCRIPTION OF THE DRAWINGS

FIG. 1 is a perspective view of an improved elastomeric electrical connector according to this invention.

FIG. 2 is a lateral sectional view of the freestanding connector of FIG. 1.

FIG. 3 is a sectional view similar to FIG. 2, showing the connector of this invention as it may be compressed and constrained during electrically interconnection of a pair of parallelly arranged planar electronic devices.

DETAILED DESCRIPTION OF PREFERRED EMBODIMENT

Figure 4:
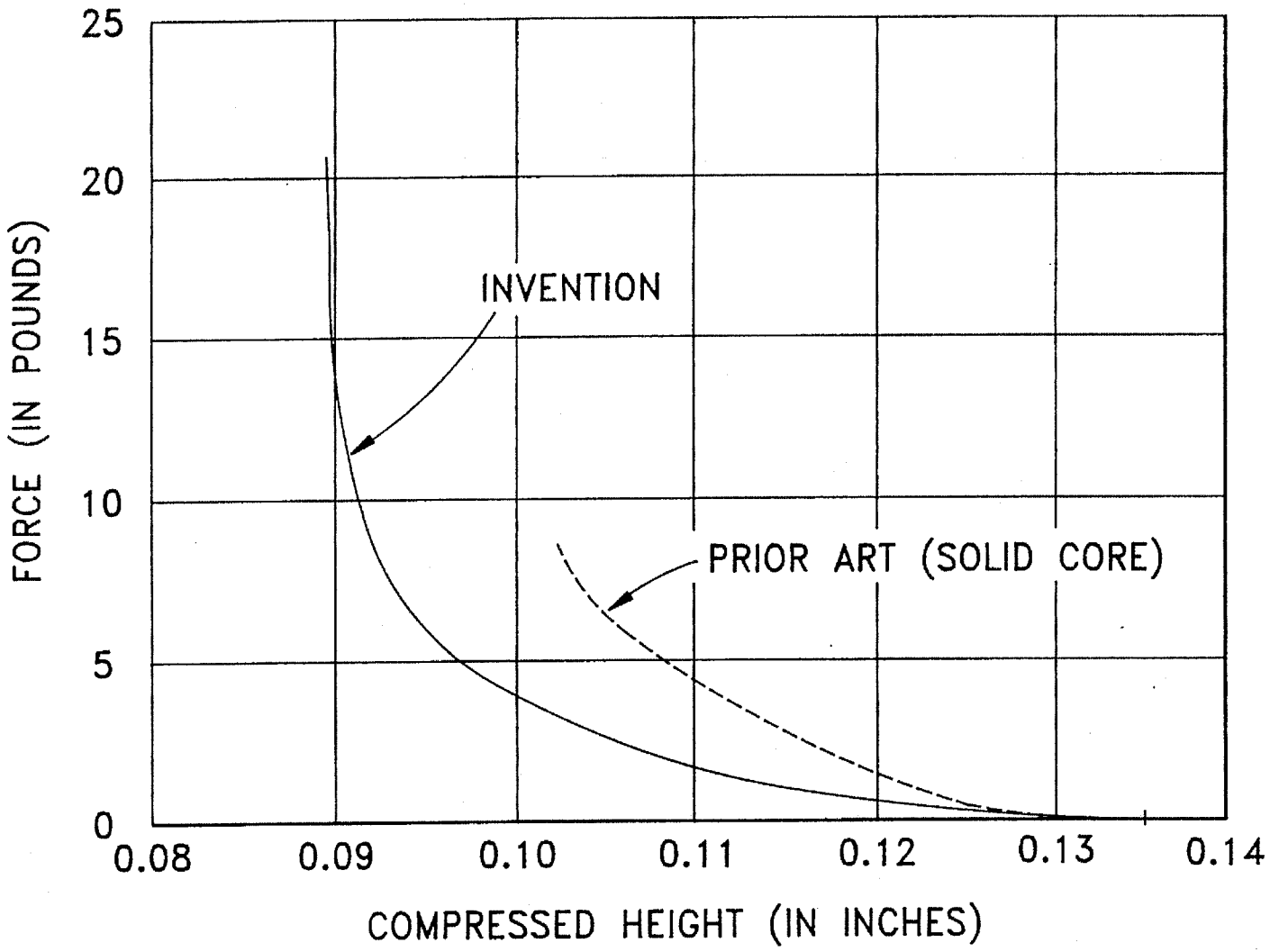
FIG. 4 is Force vs. Compression graph comparing an elastomeric connector of the prior art utilizing a solid rubber core, to an elastomeric connector of this invention.

This invention relates to an improved elastomeric connector of the type having a flexible film with conductive surface patterns, supported by insulating silicone rubber, where such connector is particularly suited for surface mount applications. Electrical contact is made by positioning the connector between substrates, such as a pair of printed circuit boards, and applying a low contact pressure to generate the required normal force.

FIGS. 1–3 are various views of a first embodiment of the improved elastomeric connector 10 of this invention. The connector 10, free standing in FIGS. 1 and 2, comprises a generally cylindrical elastomeric body 12 which is provided with a central axial opening 14 on which a flexible circuit generally indicated at 16 is wrapped and supported. The flexible circuit 16 comprises a thin film 18 of polymeric material, such as polyimide, which should be flexible so that it can be wrapped around the body 12 but non-yielding, i.e. which will not elongate significantly when stressed in a tensile mode. The film has a plurality of parallel relatively narrow conductors 20 on its external surface, such as etched copper circuitry plated with gold over nickel, and the developed width of the film as viewed in FIG. 1 is significantly greater than the circumference of the body 12. The marginal side portions 22 of the film are against each other and extend radially with respect to the body 12 to form a tab 24. The opposed surfaces of these marginal side portions are bonded to each other by a bonding material which is fused to the surfaces and marginal side portions. It should also be noted that the conductors 20 are of uniform length and have their ends in alignment. However, these ends do not extend to the side edges of the film (the free end of the tab 24) so that there is a bend of film adjacent to the free end of the tab which is devoid of conductors.

The inclusion of the central axial opening 14 is a distinguishing feature of this invention over commercial connectors of this type which have been known for nearly twenty years. While only a single opening has been illustrated, it will be understood that multiple openings may be used. In any case, as best seen in FIG. 2, the central axial opening reduces the mass within the area defined by the wrapped and supported film to a maximum of about 90%, with a preferred range being about 60 to 90%. By way of example, a core having a diameter of 0.150 inches has a preferred opening of about 0.05 inches, resulting in a mass reduction to about 89%. In any case, by this reduction in mass, there results a greater compliance over a greater compression range. With the use of a solid core, as found in the prior art, a large compression range due to a build up of tolerances of associated components usually results in a very high force for maximum compression. Since a solid core of silicone rubber, the preferred elastomeric material, is hydraulic in nature, this results in a very high force at the early stages of deflection. If the containing cavity, such as the connector interface slot illustrated in FIG. 3, is filled with rubber, an infinite amount of force for a very small additional deflection is required. This can result in damage, such as warping caused by localized pressure, to the pair of substrates to be electrically interconnected.

By the use of an elastomeric core that has been provided with one or more axially extending openings, the connector can be deflected inward (see FIG. 3) into the opening or openings giving the connector a greater compression range before the opening(s) is filled. An additional benefit is that there is less rubber to be deformed thereby requiring a lower force.

One can appreciate the forces that may be generated herein by the illustration of FIG. 3. Here the elastomeric connector 10 has been placed within a confining slot 30 in a connector interface 32, then compressed between a pair of planar electronic devices 34, 34'. FIG. 4 further illustrates the dramatic advantages in the use of the hollow cored elastomeric connector. An advantage hereof is the provision of a greater dynamic range. For example, by the nature of the confining and constraining slots or channels into which the connector is placed during use, after about 20% compression the solid core becomes hydraulic in nature. In contrast, the connector hereof does not become hydraulic until about 40 to 50% compression.

Figure 5:
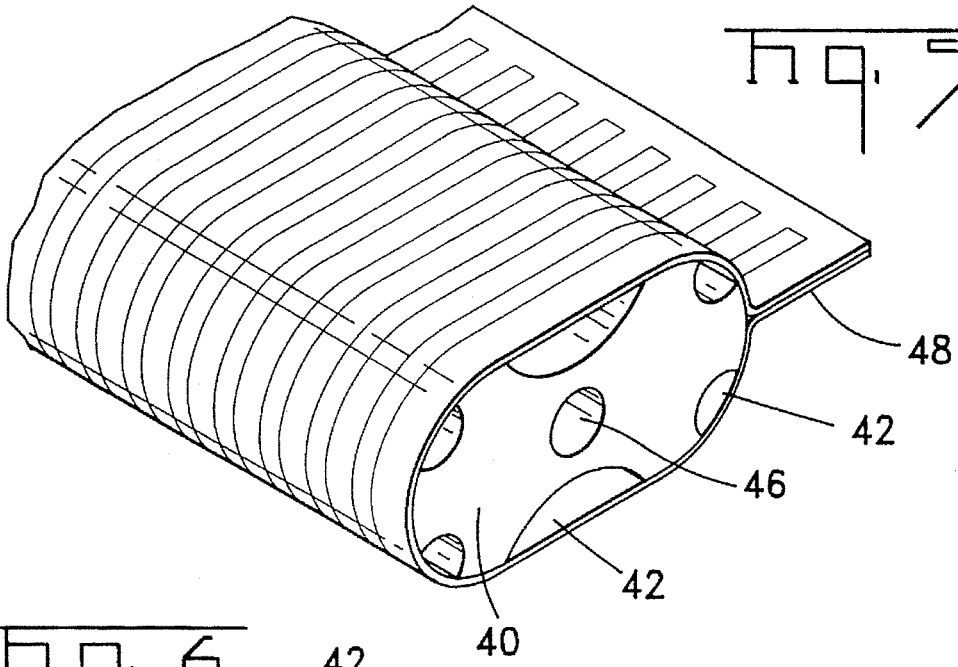
FIG. 5 is a perspective view of an alternate embodiment for the improved elastomeric electrical connector of this invention, where the elastomeric core exhibits a periphery having a plurality of axial slots or grooves.
Figure 6:
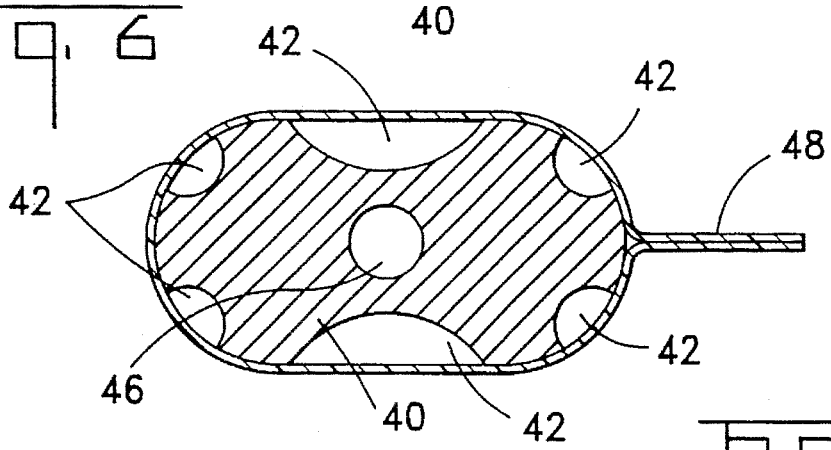
FIG. 6 is a lateral sectional view of the free standing connector of FIG. 5.
Figure 7:
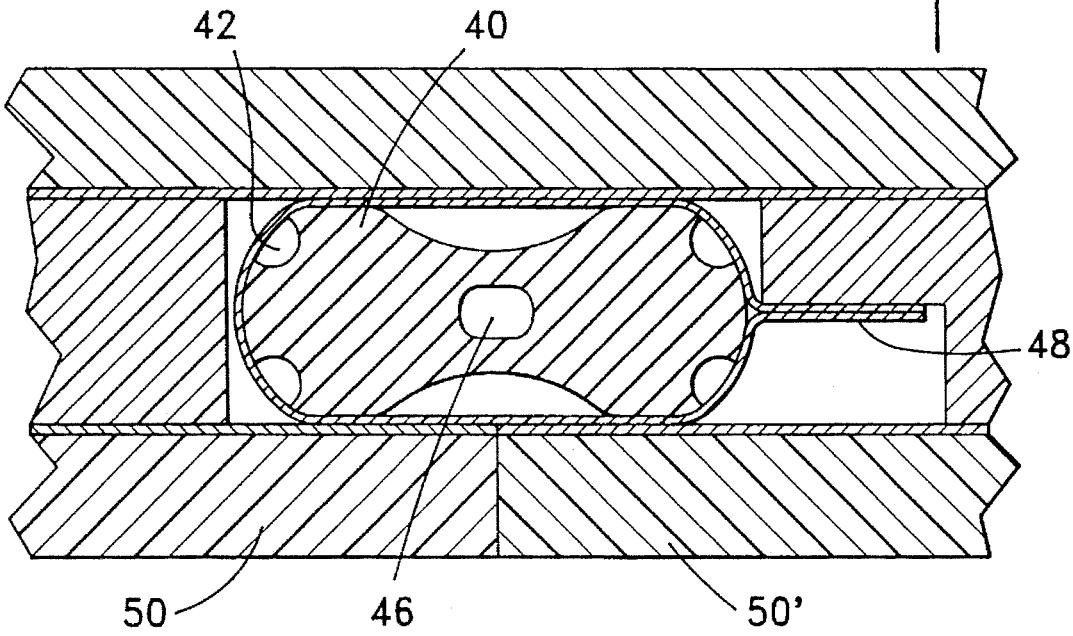
FIG. 7 is a sectional view similar to FIG. 3 showing the connector of FIG. 5 under an applied force.

FIGS. 5 to 7 represent an alternate embodiment for the improved elastomeric connector of this invention. In this alternate embodiment the core 40 has been provided with plural axially oriented grooves, depressions or slots 42 as a way to decrease the core mass, yet provide sufficient peripheral support to the overlying flexible film 44. Optionally, the core 40 may also be provided with one or more axially oriented openings 46. It will be understood that the film tail 48 may extend from the side or other location thereabout. With the tail 48 projecting from the side, as illustrated in FIGS. 6 and 7, the elastomeric connector can be used to electrically interconnect a pair of abutting boards 50, 50' along a side of the assembly.

While the embodiment of FIGS. 1 and 2 show a generally circular elastomeric core in the relaxed state, and FIGS. 5 and 6 illustrate a core having an irregular, yet symmetrical, cross section, it will be understood that the elastomeric core may assume a variety of regular or irregular cross sections under the guidelines of this invention, provided, however, there is sufficient peripheral support to the overlying flexible film at the location(s) for electrically interconnecting to the planar electronic devices.

We claim:

1. In an elastomeric electrical connector of the type including an elongated elastomeric core, having a substantially uniform cross section throughout its length, and a flexible film having electrical circuitry thereon for electrically interconnecting a pair of members having complementary electrical circuitry thereon, where said flexible film is wrapped about and supported by said elastomeric core to form said connector having a predetermined planar area, and said connector may be subjected to a compressive force to effect said electrical interconnection, the improvement comprising in combination therewith the provision of said core having a central axial opening such that the area of said elastomeric core within said planar area is between 60% and 90% of said planar area, whereby under compression said elastomeric core does not become hydraulic until 40% to 50% compression.

2. The improved elastomeric electrical connector according to claim 1, wherein said connector is confined within a fixed space when subjected to said compressive force.

3. The improved elastomeric electrical connector according to claim 1, wherein the cross section of said core prior to the application of said compressive force is essentially circular.

4. The improved elastomeric electrical connector according to claim 1, wherein said core includes at least one longitudinally oriented groove.

5. The improved elastomeric electrical connector according to claim 4, wherein said core includes an irregular periphery exhibiting different radial segments, and that said film extends between selected pairs of said segments.

6. The improved elastomeric electrical connector according to claim 5, wherein said core has a non symmetrical cross section with a flexible film peripheral supporting portion to underlie at least one of said members.

* * * * *